US008408976B2

(12) United States Patent
Stephane

(10) Patent No.: US 8,408,976 B2
(45) Date of Patent: Apr. 2, 2013

(54) OPTICAL GRADE SURFACING DEVICE

(75) Inventor: Jean Stephane, Charenton le Pont (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 610 days.

(21) Appl. No.: 12/669,051

(22) PCT Filed: Jun. 30, 2008

(86) PCT No.: PCT/FR2008/000925

§ 371 (c)(1),
(2), (4) Date: Jan. 14, 2010

(87) PCT Pub. No.: WO2009/016295

PCT Pub. Date: Feb. 5, 2009

(65) Prior Publication Data

US 2010/0178858 A1 Jul. 15, 2010

(30) Foreign Application Priority Data

Jul. 16, 2007 (FR) ..... 07 56525

(51) Int. Cl.
*B24D 15/00* (2006.01)

(52) U.S. Cl. ..... 451/512; 451/921

(58) Field of Classification Search ..... 451/512, 451/921

See application file for complete search history.

(56) References Cited

U.S. PATENT DOCUMENTS

| | | | | | |
|---|---|---|---|---|---|
| 2,282,650 | A | * | 5/1942 | Fenton | 451/528 |
| 2,309,836 | A | * | 2/1943 | Fenton | 451/507 |
| 2,990,664 | A | * | 7/1961 | Cepero | 451/42 |
| 3,897,657 | A | * | 8/1975 | Smith | 451/42 |
| 4,979,337 | A | * | 12/1990 | Duppstadt | 451/550 |
| 5,095,660 | A | * | 3/1992 | Dillon | 451/163 |
| 5,624,304 | A | * | 4/1997 | Pasch et al. | 451/287 |
| 6,458,018 | B1 | * | 10/2002 | Goers et al. | 451/41 |
| 2002/0061717 | A1 | | 5/2002 | Goulet et al. | |
| 2005/0101235 | A1 | | 5/2005 | Huguet | |
| 2006/0154581 | A1 | | 7/2006 | Bernard et al. | |

FOREIGN PATENT DOCUMENTS

| | | |
|---|---|---|
| EP | 1 777 035 | 4/2007 |
| FR | 2 834 662 | 7/2003 |
| FR | 2 857 610 | 1/2005 |
| JP | 2000-317797 | 11/2000 |

OTHER PUBLICATIONS

International Search Report dated Jan. 16, 2009, from corresponding PCT application.

* cited by examiner

*Primary Examiner* — Maurina Rachuba
(74) *Attorney, Agent, or Firm* — Young & Thompson

(57) ABSTRACT

A surface device includes a rigid holder (11), an elastically compressible interface (12) connected to the rigid holder, a flexible pad (13) adapted to be applied onto the surface to be machined (30) and a flexible belt (14) applied against and partially covering the side surface (18) of the interface (12), an annular portion (21) of the side surface (18) of the interface (12) being free between the belt (14) and the holder (11).

20 Claims, 4 Drawing Sheets

OPTICAL GRADE SURFACING DEVICE

FIELD OF THE INVENTION

The invention relates to optical grade surfacing, for surfaces such as a face of an ophthalmic lens, a camera lens or a lens of an instrument for observing distant objects or a face of a semiconductor substrate.

The term "surfacing" means any operation aiming to modify the state of a surface previously formed. This includes polishing, grinding or frosting operations aiming to modify (decrease or increase) the roughness of the surface and/or to reduce its unevenness.

TECHNOLOGICAL BACKGROUND

There is already known, in particular from Japanese patent application 2000-317797, French patent application 2 834 662, to which US patent application 20050101235 corresponds, and French patent application 2 857 610, to which US patent application 2006/0154581 corresponds, a tool for surfacing an optical surface including: a rigid support having a transverse end surface; an elastically compressible interface attached to the rigid support and having a first transverse end surface, a second transverse end surface and a lateral surface extending from the periphery of the first end surface to the periphery of the second end surface, said first end surface of the interface being pressed against and covering said end surface of the rigid support; and a flexible pad adapted to be pressed against a surface to be worked and that is pressed against and covers at least in part the second end surface of the interface on the opposite side to and in line with said end surface of the rigid support.

To reduce the roughness of the optical surface, the tool is brought into contact with it, applying sufficient pressure to it so that, by deformation of the interface, the pad espouses the shape of the optical surface.

While spraying the optical surface with a fluid, it is driven in rotation relative to the tool (or vice-versa) and swept by the tool.

The optical surface is generally driven in rotation, its rubbing against the tool being sufficient to entrain the tool conjointly in rotation.

The surfacing operation necessitates an abrasive, which can be contained in the pad or in the fluid.

During surfacing, the elastically compressible interface compensates the curvature difference between the end surface of the support of the tool and the optical surface.

The results achieved by such tools are generally satisfactory, but it is sometimes difficult to avoid certain appearance defects, in particular an orange skin effect and a sheeplike effect.

To eliminate these appearance defects, it has already been proposed that the flexible pad should have a diameter greater than the diameter of the interface so that the pad has an annular portion projecting transversely beyond the interface.

Such tools achieve improved appearance of the surface, but in some circumstances such appearance defects can remain.

OBJECT OF THE INVENTION

The invention aims to provide a surfacing tool offering particularly good performance in terms of minimizing appearance defects.

To this end it proposes an optical grade surfacing tool, including: a rigid support having a transverse end surface; an elastically compressible interface attached to the rigid support and having a first transverse end surface, a second transverse end surface and a lateral surface extending from the periphery of the first end surface to the periphery of the second end surface, said first end surface of the interface being pressed against and covering said end surface of the rigid support; and a flexible pad adapted to be pressed against a surface to be worked and that is pressed against and covers at least in part the second end surface of the interface on the opposite side to and in line with said end surface of the rigid support, characterized in that a flexible rim is pressed against and partly covers the lateral surface of the interface, said rim extending from the periphery of said pad to a free edge, an annular portion of said lateral surface of the interface being free between said free edge of said rim and the first end surface of the interface.

The flexible rim opposes lateral expansion of the interface.

Thus, when the tool is subjected to a force pressing it toward the surface to be worked, the flexible rim constrains the pressure to be distributed in a relatively uniform fashion under the surfacing tool and in particular at the edges, where pressure peaks are avoided.

The flexible rim also limits deformations of the interface caused by forces moving the tool relative to the surface to be worked.

The annular free portion of the lateral surface of the interface nevertheless enables the latter to retain sufficient deformation capacity for the pad to be able to espouse the shape of the surface to be worked.

The flexible nature of the rim also contributes to this capacity for deformation, while locating the rim between the periphery of the pad and the annular free portion of the lateral surface of the pad is particularly advantageous for limiting lateral expansion of the pad when the tool is subjected to a force pressing it toward the surface to be worked, increasingly so as the diameter of the tool increases.

Thus, generally speaking, the tool of the invention offers improved behavior compared to prior art tools which do not include a flexible rim.

All conditions being otherwise unchanged, this achieves an improved surface state and in particular reduces the orange skin and sheeplike effects.

Also, all conditions being otherwise unchanged, the tool of the invention deploys more effective surfacing parameters and in particular increased pressure and speed.

According to preferred features, said rim is made in one piece with the pad.

It is therefore particularly simple and convenient to obtain a tool according to the invention, while there exists between the pad and the rim a continuity that is favorable to the durability of the tool and to the quality of the surfacing effected.

Preferably, for the same reasons:

- said rim is formed by a bent raised edge at the periphery of the pad;
- said rim has V-contour notches pointing toward said pad;
- the tool includes a cup-shaped shell the bottom wall of which forms said pad and the lateral wall of which forms said rim;
- said interface is of a material molded onto said shell;
- said rim is stuck to said interface;
- said rim is of a material molded onto said interface;
- said interface includes an elastically compressible material plate that is more rigid than the body that forms the remainder of said interface, said plate being disposed between said pad and said body;
- said body has a peripheral portion that surrounds said plate; and/or said peripheral portion of the interface has a blunted edge between said second end face and said lateral surface.

According to other features that are preferred because of the quality of the results obtained, the distance between said free edge of said rim and said first end surface is between 30% and 70% of the distance between said first end surface and said second end surface of the interface.

In a first preferred embodiment, said support, said interface and said pad have similar diameters.

In a second preferred embodiment, said interface and said pad have a similar diameter greater than the diameter of said support, said tool further including spring return means disposed between said rigid support and the periphery of said interface.

BRIEF DESCRIPTION OF THE DRAWINGS

The description of the invention continues now with a detailed description of preferred embodiments given hereinafter by way of nonlimiting illustration and with reference to the appended drawings. In the drawings.

Figure 1:
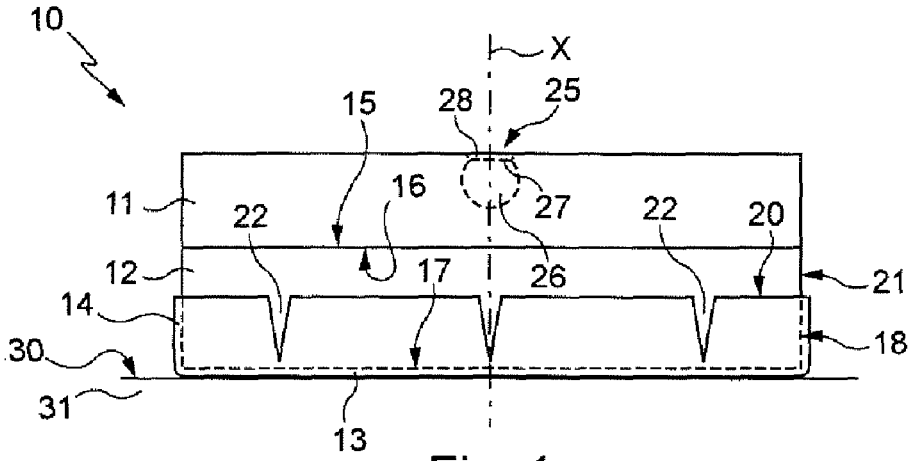
FIG. 1 is a view in elevation of a first embodiment of a surfacing tool of the invention.
Figure 2:
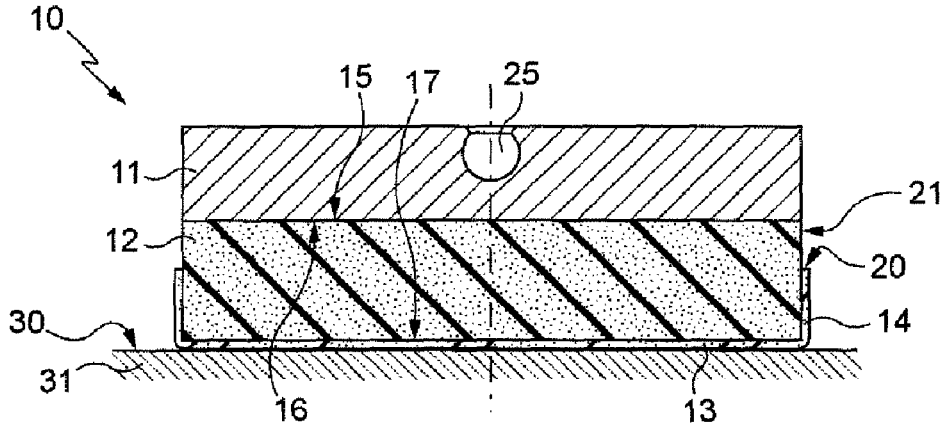
FIG. 2 is a view in section similar to FIG. 1.

The tool 10 shown in FIGS. 1 to 4 includes a rigid support 11, an elastically compressible interface 12, a flexible pad 13 and a flexible rim 14.

The support 11, and more generally the tool 10, is circularly cylindrical overall and has an axis X of symmetry that defines a longitudinal direction.

The support 11 has an end surface 15.

The interface 12 has a first end surface 16, a second end surface 17, and a lateral surface 18 extending from the periphery of the surface 16 to the periphery of the surface 17.

The surface 15 extends transversely and here is plane.

In the absence of loads, the interface 12 and the pad 13 have the general shape of a disc of the same diameter as the surface 15 and the thickness of the interface 12 is greater than the thickness of the pad 13.

The surface 16 of the interface 12 is pressed against and covers the surface 15 of the support 11.

The pad 13 is pressed against and covers the surface 17 of the interface 12.

Thus the support 11 and the pad 13 are on respective opposite sides of the interface 12.

The rim 14 extends from the periphery of the pad 13 to a free edge 20, an annular portion 21 of the lateral surface 18 being free between the edge 20 of the rim 14 and the surface 16 of the interface 12.

The rim 14 and the pad 13 are obtained from a disc of flexible material of uniform thickness, an annular peripheral strip of which, intended to become the rim 14, has notches at regular intervals that become the notches 22 when this annular strip is raised to become the rim 14. The notches 22 have a V-shaped contour pointing toward the pad 13.

The attachment between the support 11 and the interface 12 is here effected by gluing over the whole of the surfaces 15 and 16. The attachment between the one-piece assembly formed by the pad 13 and the rim 14 is here effected by gluing the whole of the pad 13 and the rim 14 to the surfaces 17 and 18.

The support 11 has a cavity 25 opening onto the side opposite the end surface 15 and extending axially over a portion of the thickness of the support 11.

The cavity 25 is centrally disposed and is adapted for mounting the tool 10 on the head of the spindle of a surfacing machine.

The cavity 25 has a spherical portion 26 with a global shape of three quarters of a sphere, an annular rib 27, and a frusto-conical portion 28, the annular rib 27 being disposed between the portions 26 and 28.

The spindle head adapted to be accepted into the cavity 25 has a part-spherical end conformed like the portion 26 and a cylindrical portion of smaller diameter than the rib 27.

The connection between the support 11 and the spindle of the machine is effected by a simple clipping action, the rib being able to deform so that the spherical portion of the spindle head is housed in the portion 26.

When the spindle head is engaged in the cavity 25, the tool 10 and the spindle cooperate in the manner of a ball-joint.

To simplify the description, the tool 10 is shown applied to an optical surface 30 that is plane, but in practice an optical surface is curved (concave or convex), of course.

To effect a surfacing operation, the lens 31 of which the surface 30 is part is mounted on a rotary support (not shown) and the tool 10 is pressed against the surface 30 with sufficient force for the pad 13 to espouse its shape.

Here the tool 10 is free to rotate although off-centre relative to the optical surface 30.

The rubbing between the optical surface 30 and the pad 13 is sufficient to entrain the tool 10 in rotation in the same direction as the lens 31 about the axis X of symmetry of the support 11.

The optical surface 30 is sprayed with an abrasive or non-abrasive fluid, depending on whether the pad has the abrasion function itself or not.

To sweep the whole of the optical surface 2, the tool 10 is moved along a radial trajectory during the surfacing operation, the point of intersection of the rotation axis X of the tool 11 with the optical surface 11 effecting a to-and-fro movement between two turnaround points.

Accordingly, during the surfacing operation, the tool 11 is subjected, relative to the lens 31, both to forces pressing it toward the surface 30 to be worked and forces moving it along that surface.

Figure 3:
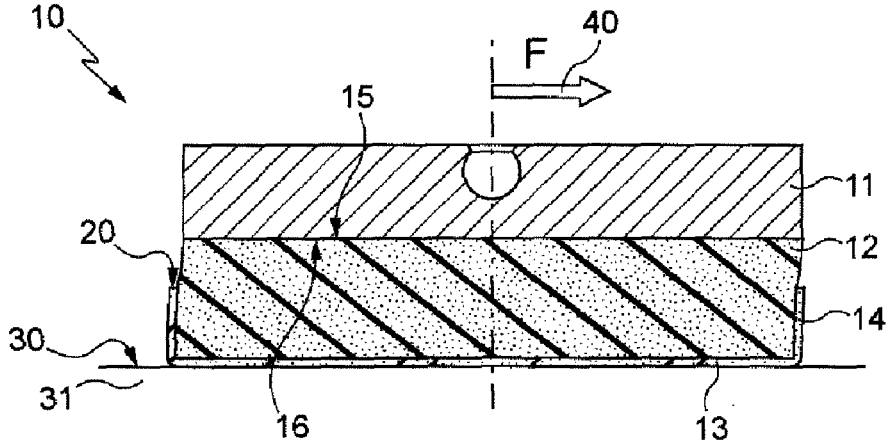
FIGS. 3 and 4 are views similar to FIG. 2, showing how the tool is deformed when it is subjected to a force moving it along the surface to be worked and when it is subjected to a force pressing it toward the surface to be worked, respectively.

FIG. 3 shows how the tool 10 is deformed when the tool is subjected to a force 40 moving it along the surface 30 to be worked.

Because it is rigid, the support 11 is not deformed, of course.

On the other hand, the interface 12, which is elastically compressible, and the pad 13 and the rim 14, which are flexible, are liable to be deformed.

Application of the movement force 40 tends to create a transverse offset between the pad 13 and the support 11.

Thus in the example shown, in which the force 40 is directed toward the right-hand side of the drawing, the pad 13 is slightly offset relative to the support 11 toward the left-hand side of the drawing.

It is seen that it is essentially the interface portion 12 situated between the surface 16 and the edge 20 of the rim 14 that is deformed.

The portion of the interface 12 surrounded by the rim 14 is deformed little, if at all, the rim 14 opposing deformation of the lateral surface of the interface 12.

Figure 4:
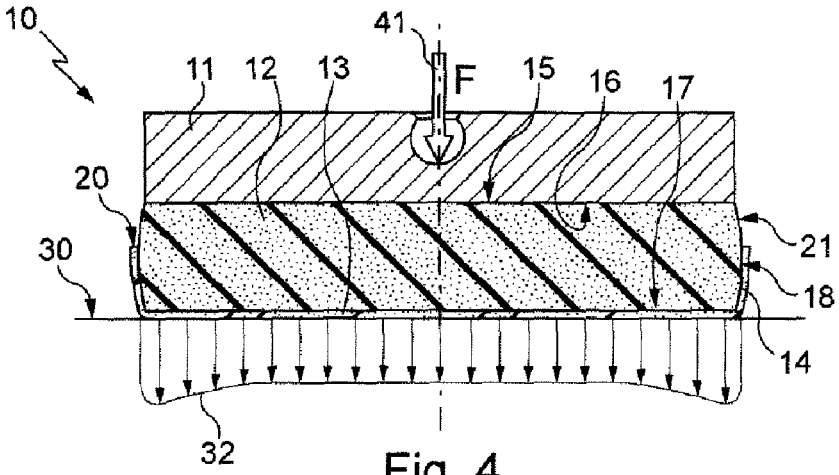

FIG. 4 shows how the tool 10 is deformed when the tool is subjected to a force 41 pressing it toward the surface 30 to be worked.

The force 41 tends to compress the interface 12 and consequently tends to cause the lateral surface 18 to assume a domed shape causing a shear effect in the vicinity of this lateral surface.

Thanks to the rim 14, the deformation of the lateral surface 18 remains moderate, the rim 14 against deformation of the surface 18.

FIG. 4 shows the distribution 32 of the pressure exerted by the tool 10 on the surface 30.

It is seen that this pressure is relatively uniform with a slight increase toward the periphery of the tool.

Figure 5:
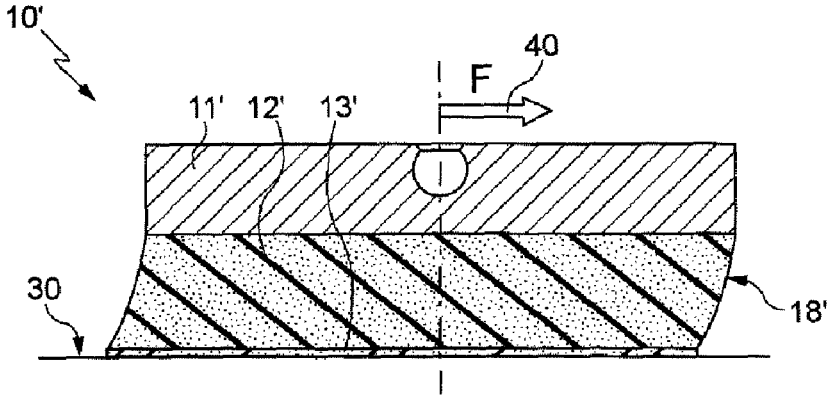
Fig. 5 Prior art
FIGS. 5 and 6 are views similar to FIGS. 3 and 4, respectively, but for a prior art tool.
Figure 6:
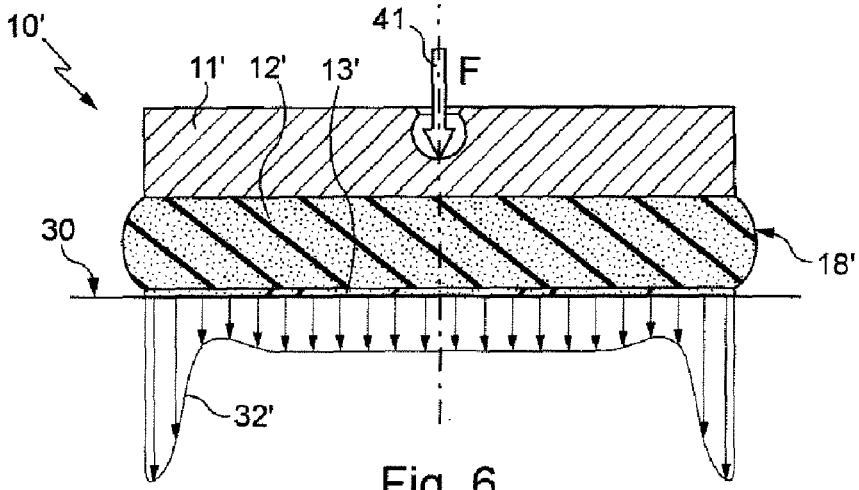
Fig. 6 Prior art

The tool 10' shown in FIGS. 5 and 6 is similar to the tool 10 except that it has no rim 14. The same reference numbers are used as for the tool 10 but "primed" (').

The tool 10' is described in Japanese patent application 2000-317797 in particular.

FIG. 5 shows how the tool 10' is deformed when it is subjected to the movement force 40.

Comparing FIGS. 3 and 5, it is seen that the transverse offset between the pad 13' and the support 11' is much greater than the transverse offset between the pad 13 and the support 11.

FIG. 6 shows how the tool 10' is deformed when it is subjected to the force 41 pressing it toward the surface 30.

Comparing FIGS. 4 and 6, it is seen that the lateral surface 18' of the interface 12' is much more domed.

The effect of shear is much greater in the vicinity of the surface 18' than in the vicinity of the surface 18, and so there is a pressure peak in this vicinity, as the pressure distribution 32' shows, associated in some cases with an area of lower pressure.

By opposing lateral expansion of the interface 12, the rim 14 produces a better pressure distribution under the tool 10.

Thanks to the portion 21 of the lateral surface 18 that remains free between the edge 20 of the rim 14 and the transverse surface 16 of the interface 12, the latter retains sufficient deformation capacity for the pad 13 to be able to espouse the shape of the surface 30.

In the example shown, the distance between the edge 20 and the transverse surface 16 is slightly greater than half the thickness of the interface 12 (the distance between the surfaces 16 and 17) in the absence of any load.

In practice the distance between the surface 16 and the edge 20 is between 30% and 70%, preferably of the order of 50%, of the thickness of the interface 12 in the absence of any load.

Thanks to the increased resistance to lateral shear that the rim 14 produces, the tool 10 has a better general behavior than the tool 10'.

All conditions being otherwise unchanged, this produces a better surface state and in particular reduces the orange skin and sheeplike effects that can be caused by pressure peaks in the vicinity of the edges of the tool.

All conditions being otherwise unchanged, the tool also deploys more effective surfacing parameters, in particular increased pressure and speed.

Figure 7:
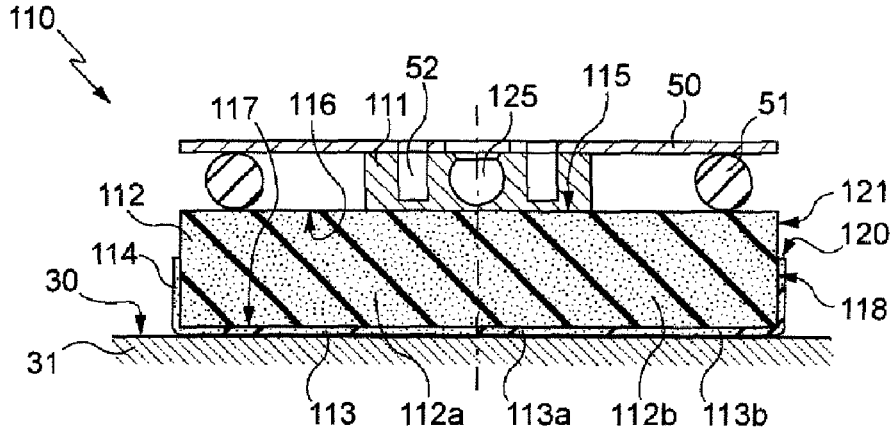
FIGS. 7 and 8 are views similar to FIGS. 2 and 6, respectively, for a second embodiment of the tool of the invention.

A variant 110 of the tool 10 is described next with reference to FIG. 7. The same reference numbers are used for similar components but increased by 100.

The interface 112, the pad 113 and the rim 114 are like the interface 12, the pad 13 and the rim 14, except that their diameter is much greater than that of the rigid support 111, and return spring means 50 and a deformable ring 51 are disposed between the interface 112 and the return means 50.

Because the diameter of the interface 112 is much greater than that of the support 111, the interface 112 has a central part **112*a* that is in line with the end surface 115 and a peripheral part 112*b* that is transversely beyond the end surface 115**.

Similarly, the pad 113 has a central part **113*a* that is in line with the end surface 115 of the support 111 and a peripheral part 113*b* that is transversely beyond the end surface 115**.

The ring 51 is pressed onto the peripheral part **112*b* on the same side as the support 111 and so the latter is surrounded by the ring 51**.

Here the ring 51 is toroidal and disposed concentrically with the support 111.

The return means 50 take the form of a star-shaped part having a central portion and a plurality of branches each forming an elastically flexible blade extending radially in a transverse plane.

The star-shaped part 50 is fixed to the support 111 by screws (not shown) the shanks of which are engaged in threaded bores 52 in the support 111 with the heads of the screws bearing on the side of the star-shaped part 50 opposite the support 111.

Figure 8:
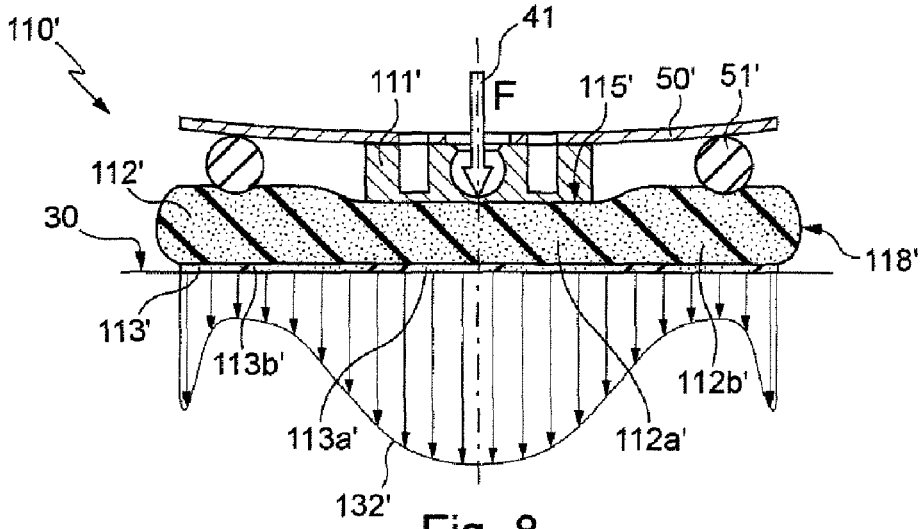

The tool 110' shown in FIG. 8 is similar to the tool 101 except that it has no rim 114. The same reference numbers are used as for the tool 101, but "primed" (').

The tool 101' is described in French patent application 2 834 662 in particular, to which US patent application 2005/0101235 corresponds.

During surfacing, the pad 113' is deformed to espouse the shape of the optical surface thanks to deformation of the flexible blades of the star-shaped part.

Given the rigidity of the support 111', material is removed for the most part in line with the end surface 115', i.e. material is removed essentially by the central part **113*a*' of the pad 113'**.

As for the peripheral parts **113*b*' and 112*b*' of the pad 113 and the interface 112, they essentially have a stabilizing role, on the one hand, thanks to the increase in the span or seating of the tool 110' relative to a standard tool whose pad and interface would be limited to the central parts 113*a*' and 112*a*' and, on the other hand, thanks to the return means 50 that maintain permanent contact between the peripheral part 113*b*' of the pad 113 and the optical surface 30**.

The deformable ring 51' smoothes the distribution of loads on the peripheral perimeter of the interface 112' and consequently on the pad 113' via the blades of the star-shaped part.

As shown by the distribution 132' of the pressure exerted on the surface 30 by the tool 110', pressure peaks exist in the vicinity of the lateral surface 118', for the same reasons as for the tool 10'.

The rim 114 prevents such pressure peaks and the pressure distribution in the vicinity of the lateral surface 118 has a shape close to the pressure distribution 32 in the vicinity of the lateral wall 18 of the tool 10.

The rim 114 therefore imparts to the tool 110 beneficial effects similar to those imparted to the tool by the rim 14, both with regard to behavior in relation to the force 41 pressing it toward the surface 30 and the force 40 moving it relative to that surface.

Figure 9:
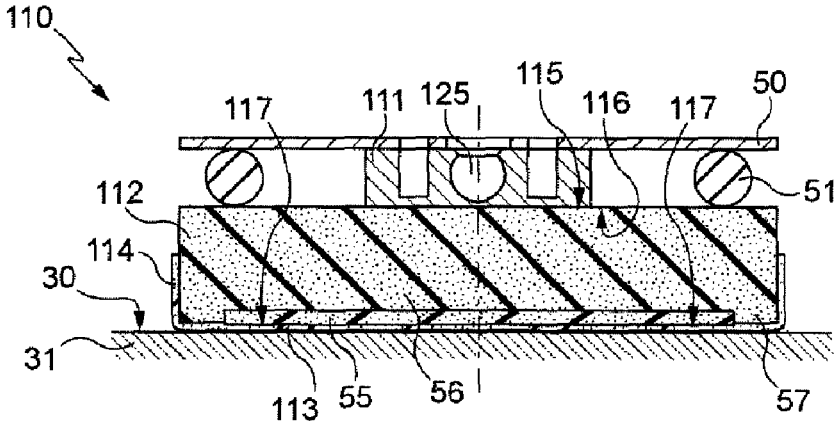
FIGS. 9 and 10 are views similar to FIG. 7, respectively for a first variant and a second variant of the second embodiment of the tool of the invention.

In the variant of the tool 110 shown in FIG. 9, the interface 112 includes an elastically compressible material plate 55 that is more rigid than the body 56 that forms the rest of the interface 112.

The plate 55 is disposed between the pad 113 and the body 56, with the exception of a peripheral portion 57 that surrounds the plate 55.

Thanks to the plate 55, the interface 112 is sufficiently compressible to espouse the surface to be worked and for the end surface 117 to have sufficient strength for a particularly flexible pad 113 to be used.

The peripheral portion 57 means that the periphery of the interface 112 retains a capacity for deformation preventing edge effects.

Figure 10:
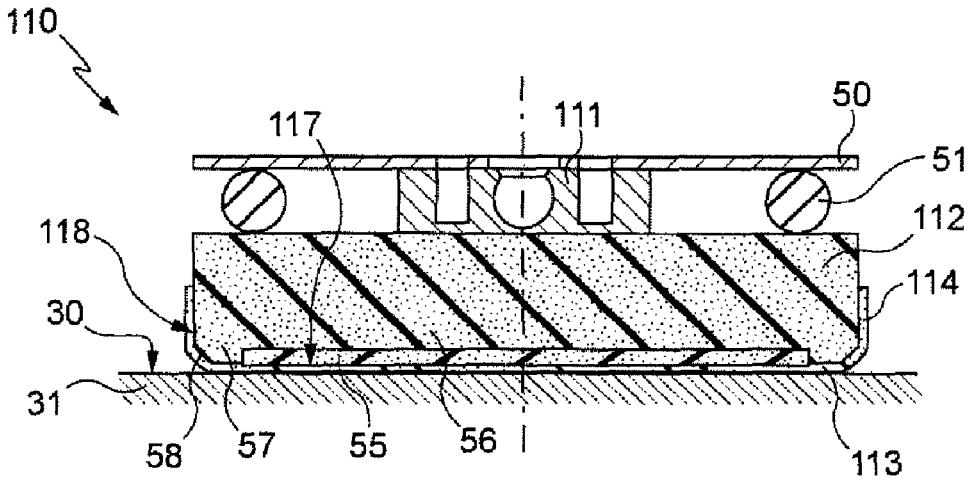

The second variant of the tool 110 shown in FIG. 10 is similar to that shown in FIG. 9, except that the peripheral portion 57 of the body 56 has a chamfer 58 to blunt the edge between the end surface 117 and the lateral surface 118. The chamfer 57 is favorable to the quality of the surface state that the tool 110 produces.

In another variant that is not shown, the chamfer 110 is replaced by a toroidal bead.

In variants that are not shown, the mode of cooperation between the spring return means 50 and the interface 112 is different, for example with the ring 51 replaced by a continuous peripheral part of the star-shaped part 50, as described in French patent application 2 857 610 to which US patent application 2006/0154581 corresponds.

In variants that are not shown, a plate like the plate 55 and/or a blunted edge like the edge 58 are provided in a tool like the tool 10.

Figure 11:
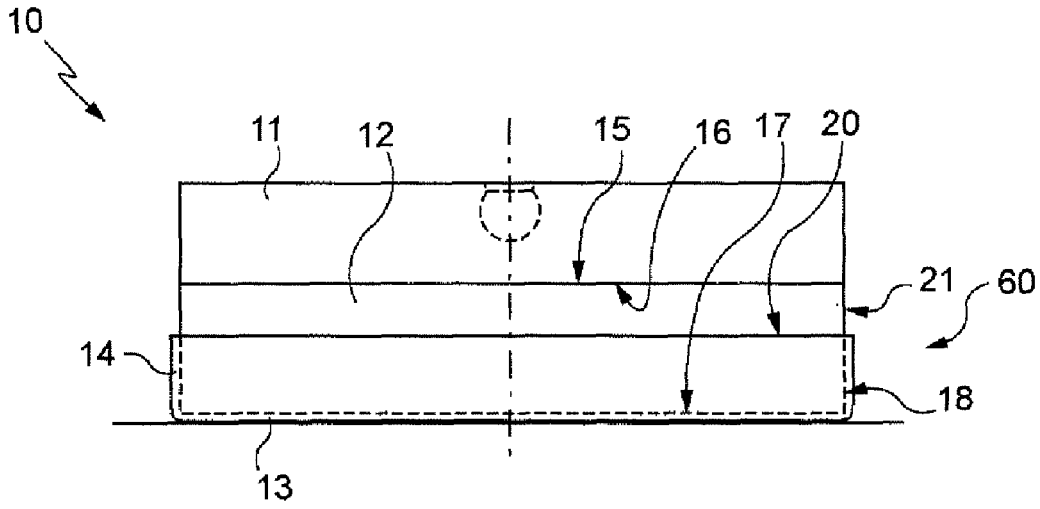
FIG. 11 is a view similar to FIG. 1 for a variant of the first embodiment of the tool of the invention.
Figure 12:
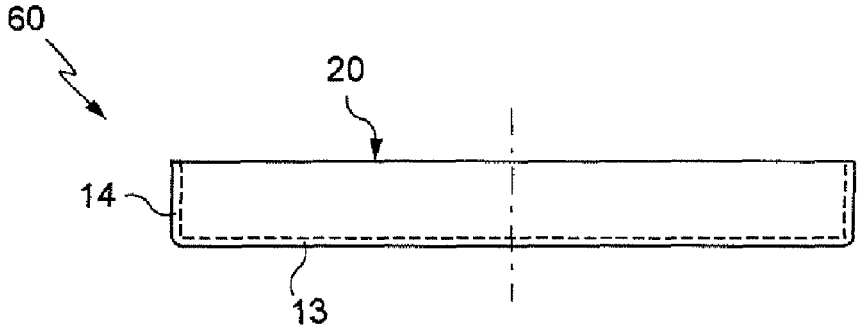
FIG. 12 shows in isolation the shell of this variant of the tool for forming the flexible pad and the flexible rim.

In the variant of the tool 10 shown in FIG. 11, the pad 13 and the rim 14 are made in one piece by preforming an appropriate material to yield a cup-shaped shell 60 the base wall of which forms the pad 13 and the lateral wall of which forms the rim 14.

Here the shell 60 is obtained by thermoforming a film of plastic material or a fabric impregnated with plastic material.

It is of course possible to use a shell like the shell 60 in the tool 110.

Providing a shell like the shell 60 is particularly beneficial for materials that are difficult to bend, which do not lend themselves to producing a rim like the rim 14 or 114 by raising the edges of a disc made from this kind of material.

The attachment of the cup-shaped shell to the interface such as the interface 12 or 112 is effected by gluing if the interface is fabricated separately or directly if the interface is produced by molding the latter in the shell.

In a variant that is not shown, the combination formed by the pad such as the pad 13 or 113 and the rim such as the rim 14 or 114 is obtained by molding it onto the interface such as the interface 12 or 112.

In this latter variant, the pad and the rim are of hard LP polyurethane foam, for example.

When it is not molded, the assembly forming the pad such as the pad 13 or 113 and the rim such as the rim 14 or 114 is made from chamois hide, for example, buffalo hide, a woven polishing duster, of the material Cémoy® from the company TORAY, or a film of smooth or slightly structured (wafer-effect) plastic material.

The interface such as the interface 12 or 112 is of polyurethane foam with a density of 220 kg/m$^3$ and a thickness from 9 to 12 mm, for example.

As indicated above, the optical surface 30 is shown as plane in the drawings to simplify the description.

Of course, in practice, the optical surface 30 is not plane, but curved, with a shape that can be especially complex, for example if it is one of the faces of a progressive lens for correcting the sight of a presbyotic, short-sighted and astigmatic wearer.

Similarly, the deformations resulting from a force 40 moving the tool relative to the optical surface and a force 21 pressing it toward that surface have been described separately, but it is obvious that in practice the two types of force are exerted simultaneously.

The tool of the invention is usable for optical grade surfacing of non-optical surfaces, for example one face of a semiconductor material wafer.

In a variant that is not shown, the pad such as the pad 13 or 113 does not cover the whole of the surface such as the surface 17 or 117, for example because the pad is flower-shaped with a solid core from which petals extend radially.

In another variant that is not shown, the pad such as the pad 13 or 113 and the rim 14 or 114 are not made in one piece but in two separate parts respectively attached to the end surface such as the surface 17 or 117 and the lateral surface such as the surface 18 or 118.

In further variants that are not shown, cooperation between the surfacing tool and the head of the spindle of the surfacing machine is effected otherwise than by a cavity such as the cavity 25 or 125 and/or the tool is driven in rotation by the spindle on which it is mounted, for example thanks to a gimbal joint.

In other variants which are not shown, the end surface such as the surface 15 or 115 of the support such as the support 11 or 111 is concave or convex, instead of being plane.

Numerous other variants are possible, of course, depending on circumstances, and the invention is not limited to the examples described and shown.

The invention claimed is:

1. Optical grade surfacing tool, including:

a rigid support (11; 111) having a transverse end surface (15; 115);

an elastically compressible interface (12; 112) attached to the rigid support (11; 111) and having a first transverse end surface (16; 116), a second transverse end surface (17; 117) and a lateral surface (18; 118) extending from the periphery of the first end surface (16; 116) to the periphery of the second end surface (17; 117), said first end surface (16; 116) of the interface (12; 112) being pressed against and covering said end surface (15; 115) of the rigid support (11; 111); and a flexible pad (13; 113) adapted to be pressed against a surface (30) to be worked and that is pressed against and covers at least in part the second end surface (17; 117) of the interface (12; 112) on the opposite side to and in line with said end surface (15; 115) of the rigid support (11; 111);

wherein a flexible rim (14; 114) is pressed against and partly covers the lateral surface (18; 118) of the interface, said rim (14; 114) extending from the periphery of said pad (13; 113) to a free edge (20; 120), an annular portion (21; 121) of said lateral surface (18; 118) of the interface (12; 112) being free between said free edge (20; 120) of said rim (14; 114) and the first end surface (16; 116) of the interface (12; 112);

wherein said first transverse end surface (16; 116) and said second transverse end surface (17; 117) of said interface are in an absence of loads generally parallel to one another, and wherein said lateral surface (18; 118) has an extent less than that of each of first transverse end surface (16; 116) and said second transverse end surface (17; 117); and wherein said flexible rim opposes lateral expansion of said interface.

2. Tool according to claim 1, characterized in that said rim (14; 114) is made in one piece with the pad (13; 113).

3. Tool according to claim 1, characterized in that said rim (14; 114) is formed by a bent raised edge at the periphery of the pad (13; 113).

4. Tool according to claim 1, characterized in that said rim (14; 114) has V-contour notches (22) pointing toward said pad (13; 113).

5. Tool according to claim 1, characterized in that it includes a cup-shaped shell (60) the bottom wall of which forms said pad (13; 113) and the lateral wall of which forms said rim (14; 114).

6. Tool according to claim 5, characterized in that said interface (12; 112) is of a material molded onto said shell (60).

7. Tool according to claim 1, characterized in that said rim (14; 114) is stuck to said interface (12; 112).

8. Tool according to claim 1, characterized in that said rim (14; 114) is of a material molded onto said interface (12; 112).

9. Tool according to claim 1, characterized in that said interface (112) includes an elastically compressible material plate (55) that is more rigid than the body (56) that forms the remainder of said interface (112), said plate (55) being disposed between said pad (113) and said body (56).

10. Tool according to claim 9, characterized in that said body (56) has a peripheral portion (57) that surrounds said plate (55).

11. Tool according to claim 10, characterized in that said peripheral portion (57) of the interface (112) has a blunted edge (58) between said second end face (117) and said lateral surface (118).

12. Tool according to claim 1, characterized in that the distance between said free edge (20; 120) of said rim (14; 114) and said first end surface (16; 116) is between 30% and 70% of the distance between said first end surface (16; 116) and said second end surface (17; 117) of the interface (12; 112).

13. Tool according to claim 1, characterized in that said support (11), said interface (12) and said pad (13) have similar diameters.

14. Tool according to claim 1, characterized in that said interface (112) and said pad (113) have a similar diameter greater than the diameter of said support (111), said tool further including a spring return element (50) disposed between said rigid support (111) and the periphery of said interface (112).

15. Tool according to claim 2, characterized in that said rim (14; 114) is formed by a bent raised edge at the periphery of the pad (13; 113).

16. Tool according to claim 2, characterized in that said rim (14; 114) has V-contour notches (22) pointing toward said pad (13; 113).

17. Tool according to claim 3, characterized in that said rim (14; 114) has V-contour notches (22) pointing toward said pad (13; 113).

18. Tool according to claim 2, characterized in that it includes a cup-shaped shell (60) the bottom wall of which forms said pad (13; 113) and the lateral wall of which forms said rim (14; 114).

19. Tool according to claim 2, characterized in that said rim (14; 114) is of a material molded onto said interface (12; 112).

20. Tool according to claim 8, characterized in that said interface (112) includes an elastically compressible material plate (55) that is more rigid than the body (56) that forms the remainder of said interface (112), said plate (55) being disposed between said pad (113) and said body (56).

* * * * *